US012435959B2

(12) United States Patent
Laporte

(10) Patent No.: US 12,435,959 B2
(45) Date of Patent: Oct. 7, 2025

(54) THREE TARGET THROWER SYSTEM

(71) Applicant: LAPORTE HOLDING, Biot (FR)

(72) Inventor: Jean-Michel Laporte, Biot (FR)

(73) Assignee: LAPORTE HOLDING, Biot (FR)

( * ) Notice: Subject to any disclaimer, the term of this patent is extended or adjusted under 35 U.S.C. 154(b) by 169 days.

(21) Appl. No.: 18/263,081

(22) PCT Filed: Jan. 25, 2022

(86) PCT No.: PCT/EP2022/051625
§ 371 (c)(1),
(2) Date: Jul. 26, 2023

(87) PCT Pub. No.: WO2022/161947
PCT Pub. Date: Aug. 4, 2022

(65) Prior Publication Data

US 2024/0230287 A1 Jul. 11, 2024

(30) Foreign Application Priority Data

Jan. 29, 2021 (FR) ..... 2100882

(51) Int. Cl.
*F41J 9/24* (2006.01)
*F41J 9/18* (2006.01)
*F41J 9/30* (2006.01)

(52) U.S. Cl.
CPC . *F41J 9/24* (2013.01); *F41J 9/18* (2013.01); *F41J 9/30* (2013.01)

(58) Field of Classification Search
CPC . F41J 9/20; F41J 9/24; F41J 9/30; F41J 9/18; A63B 69/40; A63B 69/407; A63B 69/408
See application file for complete search history.

(56) References Cited

U.S. PATENT DOCUMENTS 5,871,003 A * 2/1999 Laporte ..... F41J 9/30 124/8
2006/0287137 A1* 12/2006 Chu ..... A63B 63/00 473/422

(Continued)

FOREIGN PATENT DOCUMENTS

GB 2407517 A 5/2005
WO 9618864 A1 6/1996

OTHER PUBLICATIONS

International Search Report issued in corresponding International Application No. PCT/EP2022/051625, dated Apr. 7, 2022, pp. 1-2, European Patent Office, Rijswijk, Netherlands.

(Continued)

*Primary Examiner* — John E Simms, Jr.
(74) *Attorney, Agent, or Firm* — HAUPTMAN HAM, LLP

(57) ABSTRACT

A target throwing system for sport shooting includes, successively along a direction of alignment, a first target throwing machine, a second target throwing machine, and a third target throwing machine, each of the first machine, the second machine and the third machine includes a throwing unit movable in rotation relative to a base, a throwing arm movable in rotation relative to the throwing unit (3), wherein the base is a base common to the first target throwing machine, the second target throwing machine and the third target throwing machine, and in that it includes a stand on which the common base is movable in rotation along a base axis.

15 Claims, 12 Drawing Sheets

(56) References Cited

U.S. PATENT DOCUMENTS

| | | | | |
|---|---|---|---|---|
| 2011/0186023 | A1* | 8/2011 | Callander | F41J 9/18<br>124/6 |
| 2015/0204638 | A1* | 7/2015 | Frazier | F41J 9/24<br>124/6 |

OTHER PUBLICATIONS

Written Opinion issued in corresponding International Application No. PCT/EP2022/051625, dated Apr. 7, 2022, pp. 1-5, European Patent Office, Rijswijk, Netherlands.

* cited by examiner

THREE TARGET THROWER SYSTEM

The present application is a U.S. National Phase of International Application Number PCT/EP2022/051625, filed Jan. 25, 2022, which claims priority to French Application No. 2100882, filed Jan. 29, 2021.

TECHNICAL FIELD OF THE INVENTION

The present invention relates to the field of sports shooting and more particularly to target throwing machines. It finds a particularly advantageous application in the field of clay pigeon shooting and in particular the "Olympic trench discipline".

PRIOR ART

The "Olympic Trench" is a discipline of shooting in series. In general, it requires fifteen shooting machines called "throwers" divided into five groups of three as illustrated in FIGS. 1 and 2. Each thrower is accurately configured to project a target repeatedly according to a very accurate trajectory. Mechanisms have been proposed conferring manually adjustable orientations on the launchers. A machine of the prior art proposed by the applicant is illustrated in FIG. 3. This machine comprises a base 1 which is fixed relative to the ground and which supports the entire machine, including a throwing unit 3. The latter is the portion of the machine at which at least one target 4 could be projected by means of a throwing arm 32 movable in rotation about an axis of rotation 33, the target 4 being guided over a surface of a throwing plate 31. In general, the rapid projection movement of the throwing arm 32 is related to the release of the energy contained in a spring tensioned during a cocking cycle.

In order to reduce the number of machines in this sport, solutions have been proposed such as that of the document US2011/186023 A1 which discloses a shooting machine the throw of a disc thereby would be adjusted according to three parameters via three motor-driven actuators. In this prior art document, it is specified that it is possible to modify the projection angle, the projection height as well as the lateral position of the machine by translation on a rail. In the context of an Olympic trench event, this technical solution would theoretically have been suitable and thus replace fifteen throwers, nevertheless it has a major drawback in use thereof because it does not allow for a satisfactory speed of execution essential for a rapid sequence of shots and its adaptability to each shot is reduced. Indeed, the time separating two target projections according to two different directions should be short enough (for example the machine should be able to travel up to two meters in translation and/or 90° in horizontal rotation between two shots), and also, on this type of solution, the increase in the speed is necessarily accompanied by a loss of accuracy of the trajectories of the targets. The patent publication WO 96/18864 A1 discloses an apparatus for throwing clay pigeon type targets in pairs. It includes two juxtaposed throwers.

In general, there is a need to optimise the facilities using target throwing machines in complex use contexts, typically that of the Olympic trap involving a plurality of relative positions between shooters and machines.

Hence, an object of the present invention is to provide a system allowing optimising the design of machines intended for throwing targets, particularly in the context of an Olympic trap competition.

The other objects, features and advantages of the present invention will appear upon examining the following description and the appended drawings. It is understood that other advantages can be incorporated therein.

SUMMARY OF THE INVENTION

To achieve this objective, according to one embodiment, a target throwing system for sport shooting is provided comprising, successively along a direction of alignment, a first target throwing machine, a second target throwing machine, and a third target throwing machine, each of the first machine, the second machine and the third machine comprising:

- a throwing unit movable in rotation relative to a base,
- a throwing arm movable in rotation relative to the throwing unit, characterised in that the base is a base common to the first target throwing machine, the second target throwing machine and the third target throwing machine, and in that it includes a stand on which the common base is movable in rotation along a base axis.

Thus, the machines are organised into a set secured in rotation. This allows adjusting the angular position of the three machines, in one single movement, in particular to adapt it to the position of a shooter, positioned on a shooting stand amongst a plurality of shooting stands. While the current techniques impose multiplying the throwing machines according to the number of shooters, the proposed systems considerably rationalise the facilities.

Another aspect relates to a facility for sport shooting comprising a system as described before and a plurality of shooting lanes arranged successively along a circle arc centred on the base axis.

According to one possibility, in this facility, the system is configured to move the common base in rotation relative to the stand to alternately place the common base in one amongst a plurality of angular positions, each position corresponding to a situation in which the direction of alignment is perpendicular to a line passing through the base axis and the centre of one of the shooting lanes.

Another aspect relates to a method for controlling system of three target throwing machines in a facility comprising:

- placing the common base with respect to the stand in an angular position of the plurality of angular positions,
- executing at least one projection of at least one target,
- moving the common base in rotation relative to the stand up to another angular position of the plurality of angular positions,
- executing again at least one projection of at least one target 4.

The placement is possibly done in an angular position corresponding to a shooting lane located at a first end of the circle arc and wherein the rotational movement and the new execution are done successively up to a shooting lane located at a second end of the circle arc.

BRIEF DESCRIPTION OF THE FIGURES

The aims, purposes, characteristics and advantages of the invention will be better understood upon reading the detailed description of one embodiment thereof, which is illustrated by means of the following accompanying drawings, in which.

Figure 1:
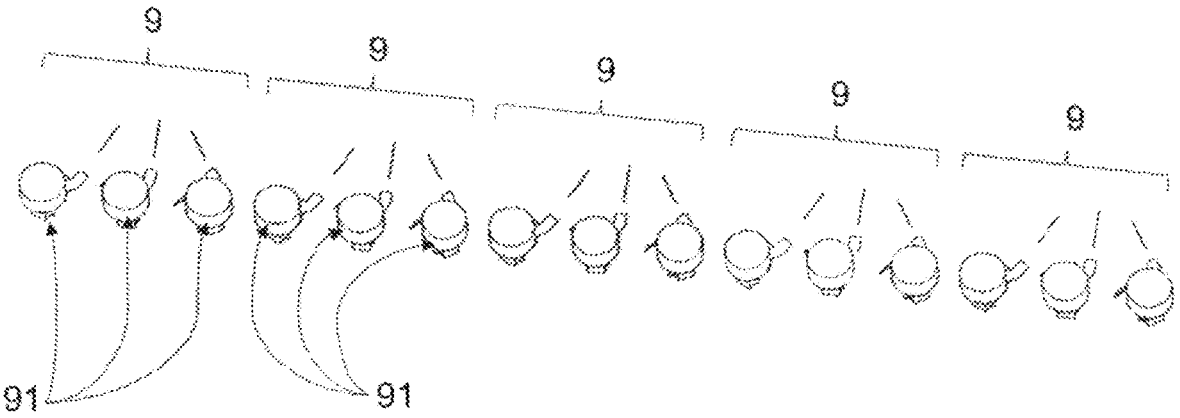
Fig.1 Prior Art
FIG. 1 represents an example of a throwing system for the Olympic trench as found in the prior art comprising five sets of three throwers.

The drawings are provided by way of example and are not intended to limit the scope of the invention. They constitute diagrammatic views intended to ease the understanding of the invention and are not necessarily to the scale of practical applications.

DETAILED DESCRIPTION

Before starting a detailed review of embodiments of the invention, optional features that may be used in combination or alternatively are set out hereinafter:

- the base axis 112 is coincident with the axis of rotation (or first direction 35), relative to the common base 110, of the throwing unit 3 of the second machine;
- a base actuator 130 is configured to drive the common base 110 in rotation relative to the stand 100;
- a rolling device 120 is interposed between an upper face 101 of the stand 100 and a lower face of the common base 110;
- the rolling device 120 includes at least one rolling set 123 comprising on the one hand a rolling track with a circle arc shaped profile centred on the base axis 112 and arranged on one amongst the upper face 101 of the stand 100, and, on the other hand, at least one roller rotatably mounted on the other one amongst the upper face 101 of the stand 100 and the lower face of the common base 110 and configured to move along the rolling track 122;
- the rolling device 120 includes several rolling sets 123 at least some of which have rolling tracks 122 having different spacings with respect to the base axis 112;
- the rolling device 120 comprises four rolling sets 123 arranged in pairs on either side of the axis of rotation, relative to the common base 110, respectively of each amongst the first machine and the second machine;
- each pair of rolling sets 123 is arranged opposite a different one amongst the throwing unit 3 of the first machine and the throwing unit 3 of the third machine;
- the rolling device 120 includes, at least one rolling set 123 arranged opposite the throwing unit 3 of the second machine;
- the rolling set 123 arranged opposite the throwing unit 3 of the second machine includes a circle-like shaped rolling track 122;
- each amongst the first machine, the second machine and the third machine is configured to respectively sweep a first angular sector 61, a second angular sector 62 and a third angular sector 63, said sectors being different from each other.

Preferably, the three machines are preconfigured to respectively sweep an angular sector amongst a plurality of different predetermined angular sectors. These machines may be identical except with regards to the angular sector of rotational deflection. A given angular sector may be assigned to each machine (different from that of the other machines), without the possibility of sector adjustment, yet, preferably, these machines are adjustable and are adjusted separately to produce this difference in the angular sector.

According to one possibility, each of the machines of the system includes a system for setting the angular sector allowing selectively reducing the angular sector to one amongst a plurality of predetermined different angular sectors comprising at least a first angular sector, a second angular sector and a third angular sector.

Therefore, the adjustment allows reducing the angular deflection and thus the throwing arm moves only a few degrees to reach the desired throwing angle. Therefore, the device is more accurate and the target is projected according to the intended trajectory. The setting system enables at least three distinct configurations for the same machine which also enables a multiple use of a standard thrower and thus a reduction in the production costs. The reduction of the angular sector to be swept allows limiting the speed of the actuator and therefore selecting actuators, in particular cylinders, that are more stable in the stop position even in the case of a power interruption; typically, the power transmission connections are more irreversible and thus avoid parasitic movements due to the forces applied by the elements of the machines.

According to one example, the adjustment system is configured to modify the position of the actuator.

This enables an advantageous optimisation of the orientation of the actuator according to the selected angular sector of deflection. Indeed, the actuator is thus ideally positioned in order to maximise its efficiency.

According to one example, the actuator 71, 72, 73 is an electric cylinder.

According to one example, the setting system comprises a plurality of anchor points where at least one anchor point of the actuator 71, 72, 73 is able to cooperate alternatively.

Preferably, the anchoring unit is at one end of the actuator, for example at the distal end of a cylinder rod or at the rear end of a cylinder body.

According to one example, an adjustment system is configured to modify an anchor point of the first actuator 71 on the base 1.

According to one example, an adjustment system is configured to modify an anchor point of the first actuator 71 on the throwing unit 3.

Preferably, the adjustment system is configured to modify a distance separating an anchoring unit of the actuator on an anchor point of the base 1 and an anchoring unit of the actuator on an anchor point of the support 2. In other words, the distance separating the anchorage of the actuator on the support 2 and the anchorage of the actuator on the base is modified using different anchor points, at least on one amongst the base and the support.

Possibly, an anchoring unit may equip one end of an actuator and another anchoring unit may equip the other end of the actuator. By anchoring unit, it should be understood any element able to ensure a connection between the actuator and a portion of the machine amongst the base and the support. By anchor point, it should be understood any element able to cooperate with an anchoring unit to ensure the connection. Typically, such a connection could be a pivot connection according to an axis parallel to that of the rotation offered by the considered actuator.

According to one example, a second actuator 72 enables an additional adjustment of the angular position of the throwing unit 3 within an angular sector of rotational deflection according to a second direction 36, enabling an inclination of the throwing unit 3 with respect to the base 1, the first direction being different from the second direction.

According to one example, an energy accumulation spring allows moving the throwing arm 32 and the machine further comprises a system for varying the tension of the spring, the system is configured so as to keep a constant projection distance and that being so regardless of the angular position adjusted by the second actuator 72 within a sector of rotation according to the second direction 36.

According to one example, the three machines are disposed so that a central machine is centred between two lateral machines and the angular sectors of the lateral machines are symmetrical with respect to a shooting direction 34 of the central machine.

According to one example, the predetermined angular sectors 61, 62, 63 intersect.

According to one example, the step of selective adjustment of the deflection angle is performed by modifying the position of the first actuator 71.

According to one example, a machine is used comprising an actuator 71, 72, 73 which comprises an anchoring unit able to cooperate with a fastening element on an anchor point amongst several anchor points on one amongst the base 1 and the support 2 to enable the selective adjustment step.

It is specified that in the context of the present invention, the term "thrower" is sometimes used instead of "machine" as a claimed object, these terms should be considered as equivalent.

In the context of the invention, the accuracy of positioning of the different components of the throwers in the assembly depends on the accuracy of the shot and thus the backlashes of the mechanisms are likely to cause theoretical lateral discrepancies in the trajectories of the targets for two identical machines. For example, once could notice a 25 cm lateral deviation for a 76 m shot. Hence, it is appropriate to accept a target trajectory deviation margin between two machines having the same adjustments. Hence, these deviations will be taken into account when two trajectories are considered as identical. The acceptable fallout uncertainty of the target may also correspond to a 2 m sided square centred at 76 m from the launcher.

In the context of the invention, by "radial orientation" or "radially", reference is made to the positioning of an element movable in rotation relative to an axis.

In the rest of the description, the term "on" does not necessarily mean "directly on". Thus, when it is indicated that a part or a member A bears "on" a part or a member B, this does not mean that the parts or members A and B are necessarily in direct contact with the other. These parts or members A and B can either be in direct contact or bear on one another through one or more other part(s). The same applies for other expressions such as the expression "A acts on B" which could mean "A acts directly on B" or "A acts on B through one or more other part(s)".

In the present patent application, the term movable corresponds to a rotational movement or to a translational movement or to a combination of movements, for example the combination of a rotation and a translation.

In the present patent application, when it is indicated that two parts are distinct, this means that these parts are separate. They are:

- positioned at a distance from each other, and/or
- movable relative to each other and/or
- secured to each other by being fastened by added elements, this fastening being removable or not.

Hence, a one-piece unitary part cannot be formed by two distinct parts.

In the present patent application, the term "secured" used to describe the connection between two parts means that the two parts are connected/fastened with respect to each other, according to all degrees of freedom, except if is explicitly specified otherwise. For example, if it is indicated that two parts are secured in translation according to a direction X, this means that the parts could be movable relative to each other except according to the direction X. In other words, if a part is moved according to the direction X, the other part performs the same movement.

In the present patent application, an elastic means may for example be a spring, such as a coil spring, elastic washers such as Belleville washers, an elastomer, a rubber.

DESCRIPTION OF THE OLYMPIC TRENCH

As a reminder of the technology that is usually encountered, and as illustrated in FIG. 1, a series of fifteen throwers 91, distributed according to a line and advantageously oriented and parameterised, allow complying with the standards required by the regulations of an official "Olympic trap" competition. In the general case, the orientation of each of the throwers 91 is configured so as to remain the same throughout an event. Thus, each thrower 91 is able to throw a target 4 according to a pre-established projection, and adjusted so as to repeat the throw as faithfully as possible in order to obtain identical trajectories.

Figure 2:
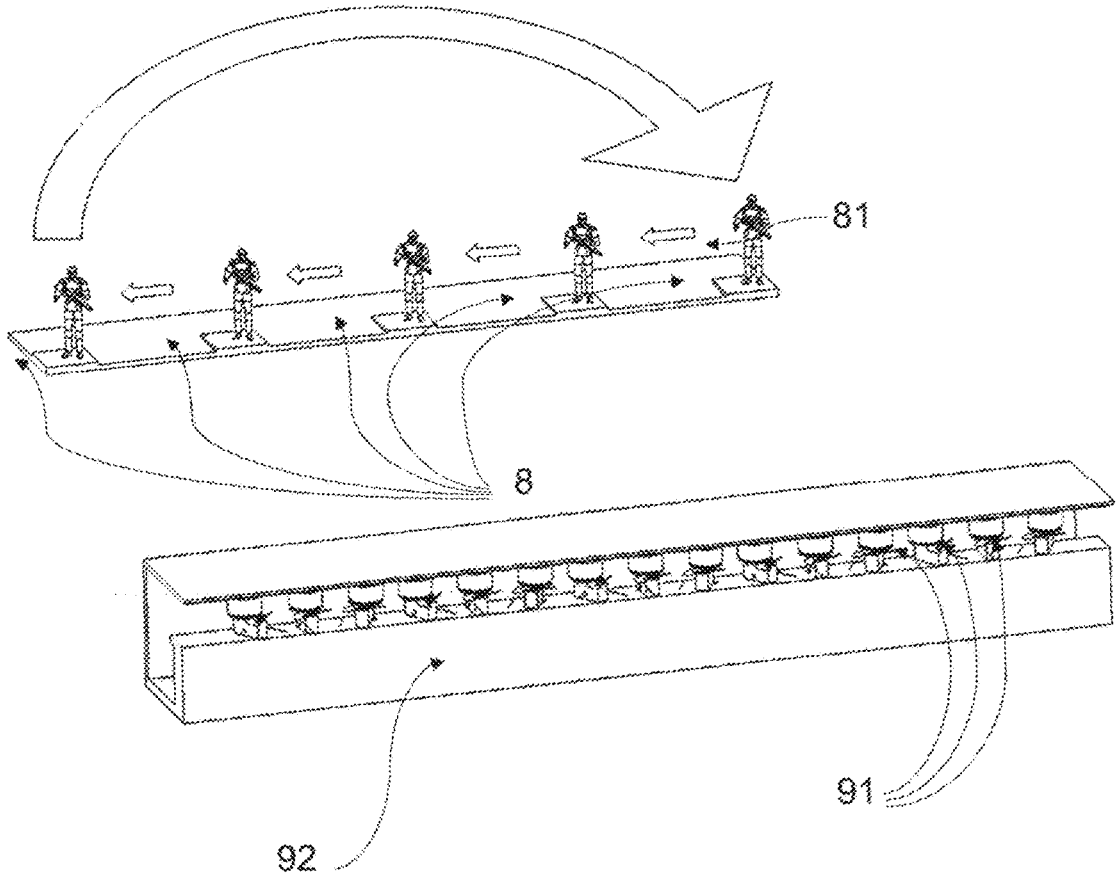
Fig.2 Prior Art
FIG. 2 represents an example of a throwing system for the Olympic trench as found in the prior art with a shooter moving on the different shooting platform locations.

As illustrated in FIG. 2, a shooter 81 moves throughout the competition between the different shooting lane locations 8 in order to position himself opposite a system 9 comprising three throwers 91 which are expected to randomly eject a projectile according to a predefined direction, either to the left, or to the right, or towards the centre. Thus, the shooter does not know in advance which one of the three throwers 91 of the system 9 will project a target 4. Possibly, each of the shooters 81 may be in position on a different shooting lane.

First of all, details are given hereinafter corresponding to possibilities that could be embodied in the throwing machines, or throwers, implemented in the system of the invention.

In a second step, the system itself is described.

Structural Description of a Thrower

Figure 3:
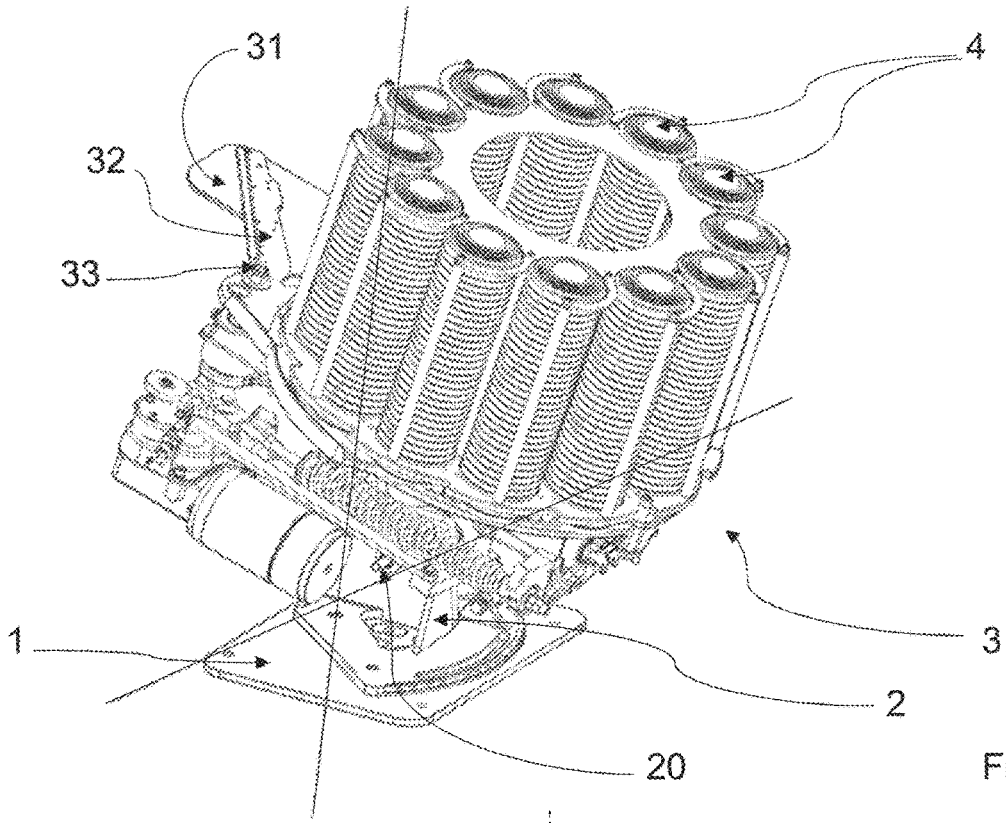
Fig.3 Prior Art
FIG. 3 represents a target thrower from the prior art.

Unless stated otherwise, the machine disclosed herein may embed one or more aspect(s) of such a thrower, the terms machines and throwers being considered to be equivalent. As illustrated in FIG. 3 and according to an example of a device from the prior art, the thrower 91 comprises a base 1 on which a throwing unit 3 is positioned through a support 2 movable in rotation relative to at the base via a support axis 20. The throwing unit comprises a throwing plate 31 as well as a throwing arm 32 movable in rotation relative to the throwing plate 31 through an axis 33. Advantageously, a target 4 is positioned on a throwing plate 31. Through an accelerated movement, the throwing arm 32 is brought to cooperate by contact with the target 4 in order to project it according to a pre-established trajectory.

Functional Description of a Launcher

According to this same example, the accelerated movement of the arm may be triggered by means of a mechanical actuator. Advantageously, it consists of an elastic means such as a tensioned spring. For example, when the spring is released, it triggers, by release of mechanical energy, an accelerated movement of the throwing arm 32 and the projection of the target 4 follows.

Figure 4A:
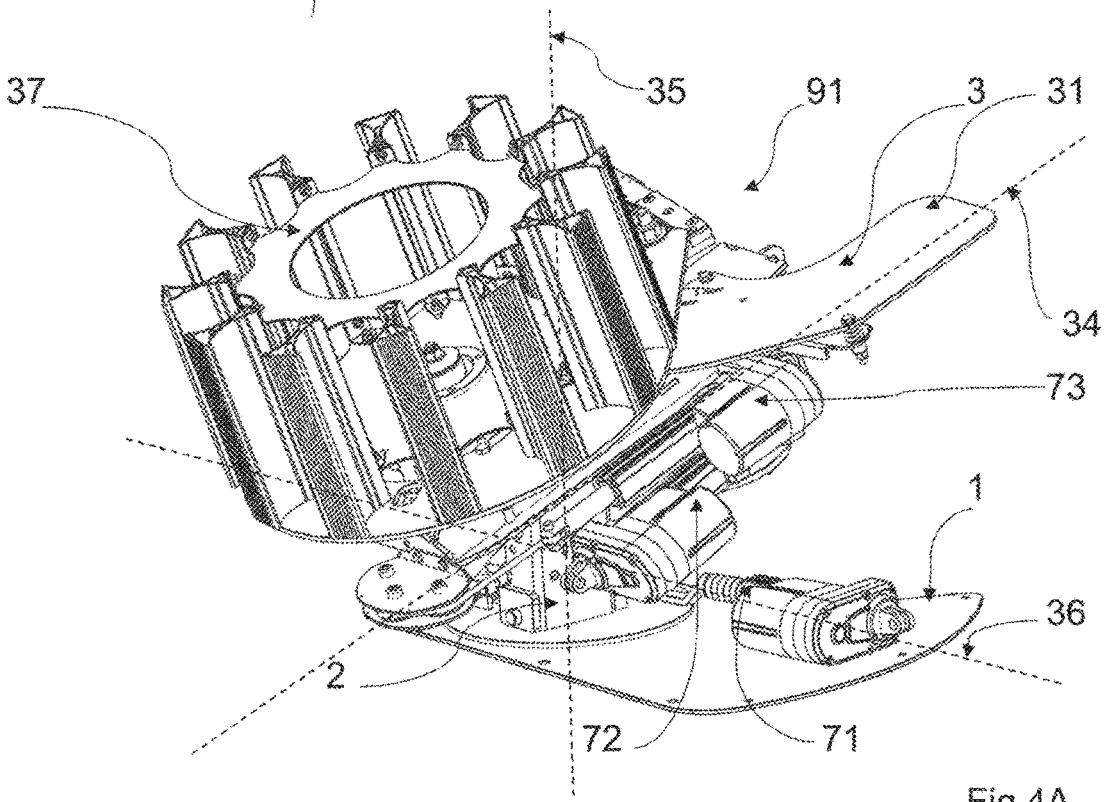
FIGS. 4A to 4B represent a launcher according to the present invention.
Figure 4B:
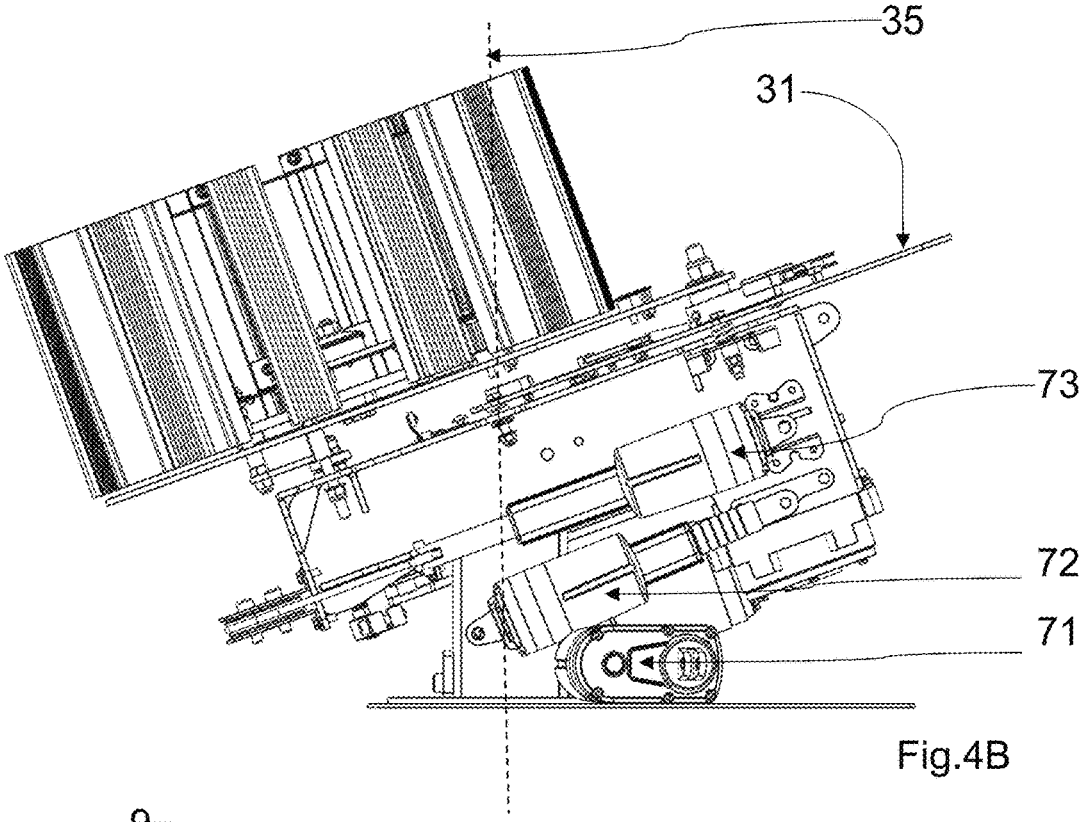

As illustrated in FIGS. 4A and 4B, and according to a preferred embodiment, the launcher 91 comprises a base 1 on which a support 2 is mounted supporting a throwing unit 3. Next, it will be seen that the base 1 of each machine is common for the three machines. Thus, the bases 1 of the machines form one single common base 100. The throwing unit 3 comprises a throwing plate 31 topped by a revolving cylinder 37 allowing reloading the targets 4 in an automated and continuous manner. The throwing unit 3 is movable in rotation relative to the support 2 according to at least one direction 36 so that the throwing plate is oriented according to a shooting direction 34 herein schematically represented in a purely illustrative manner. The support 2 is movable in rotation relative to the base 1 according to a direction 35. The first direction 35 may be vertical in a position of use of the machine in a trench; the second direction 36 may be perpendicular to the first direction 35, it may consist of a direction of inclination with respect to a horizontal plane in a position of use of the machine in a trench.

According to this same embodiment, the support 2 and the throwing unit 3 are secured in rotation according to the first direction 35 and consequently, the orientation of the throwing unit 3 according to the first direction 35, is performed simultaneously with the rotation of the support 2 relative to the base 1. This rotation is performed in an automated manner and preferably semi-automatically using a motor-driven actuator 71. The orientation could be performed laterally or in height by tuning the rotations according to the directions 35, 36. However, one single rotational mobility may be enough.

One could also consider a target projection power adjustment 4.

By motor-driven actuator 71, 72, 73, it should be understood any type of powered element intended to produce a mechanical movement by energy transformation. For example, this may consist of a hydraulic or electric power supply. The term "motor-driven" means a non-manual drive. An actuator may comprise a rod or arm movable in translation on command. It may consist of the rod of a cylinder, or a rod of a crank-rod system whose rotation is imparted by the output shaft of an engine.

According to this example, the thrower 91 is advantageously adjustable according to two and possibly three parameters and these adjustments are performed automatically. This enables the same launcher 91 to randomly project targets 4 according to a multitude of different programmed trajectories. These adjustments could then be performed in real-time during the "Olympic trench" event such that they enable an optimised configuration of the launchers.

Thus, according to this example, the invention provides a technical solution alternative to those of the prior art based on one group of three optimised launchers 91. Advantageously, this technical solution requires only one shooting point 9 since after each target projection 4, the trajectories of the three launchers 91 are preferably modified automatically, for example in less than eight seconds. The shooter 81 no longer needs to move, the system 9 with three throwers 91 is capable of replicating, in a cyclic manner, the fifteen trajectory variants of the "Olympic trap" competition regulations.

According to one embodiment, the base 1 comprises a planar surface parallel to the ground and the main direction 35 can be modelled by an axis perpendicular to the ground. Advantageously, the height of the machine is vertical when a launcher 91 is positioned for an Olympic trench event.

Actuators

In order to enables at least partial automation of the adjustments of the trajectory of a target 4, the rotation of the throwing unit 3 according to the first direction 35 using a first actuator 71, enables an automated lateral adjustment of the launcher 91. According to an example complementary to the preferred embodiment and as illustrated in FIG. 4B, the throwing unit 3 is movable in order to enable an adjustment of the inclination of the throwing plate 31 and consequently of the angle of ejection of the targets 4. This adjustment being performed using a second actuator 72. Finally, according to an example also compatible with the preferred embodiment, the launcher 91 comprises a third actuator 73 enabling an adjustment of the projection power of the target 4.

Anchorage of the Actuator

According to the preferred mode of the invention, the first actuator 71 enables an adjustment of the orientation of the base according to the direction 35 and therefore the first actuator 71 radially orients the throwing unit 3.

Figure 6:
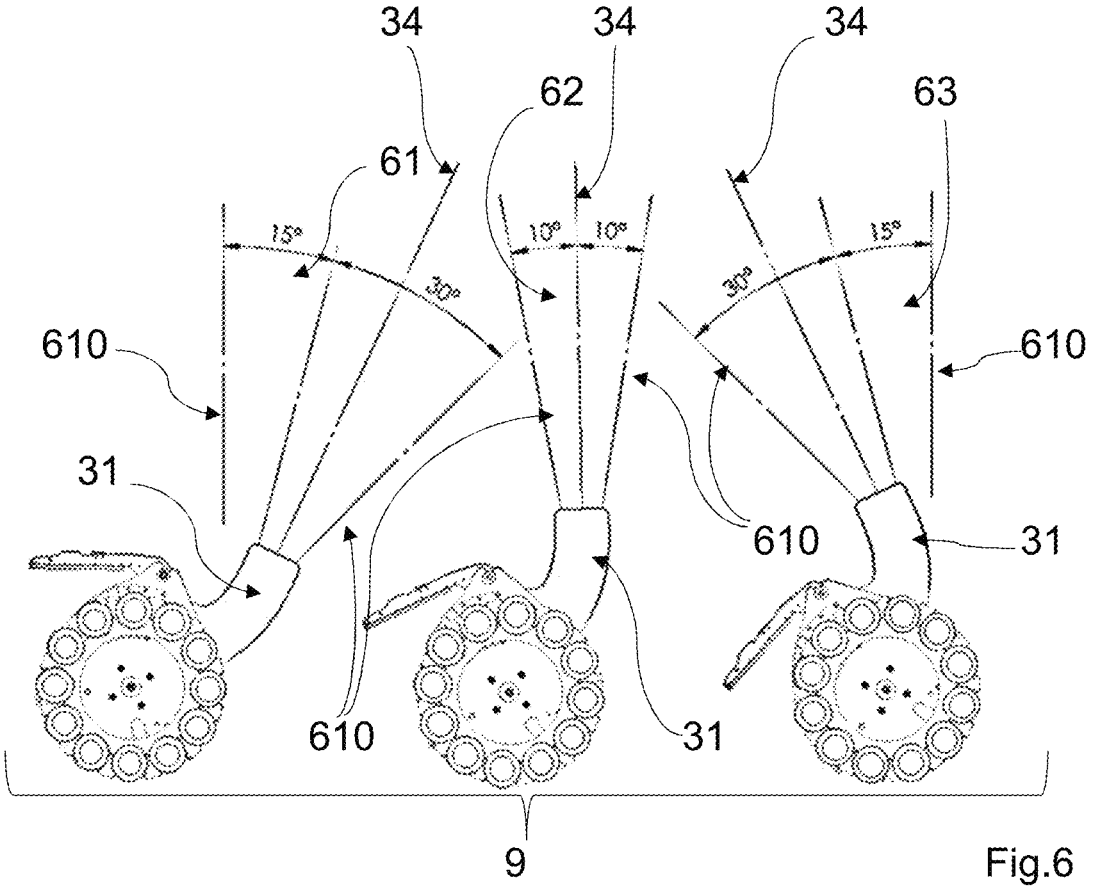
FIG. 6 represents the angular sectors of deflection of the three launchers illustrated in FIG. 5.

As illustrated in FIG. 6 and in order to allow for a better responsiveness and a better accuracy of the thrower 91, the lateral adjustment of each launcher 91 is deliberately reduced and limited between two lateral limits 610 and therefore defines a first angular sector of deflection. In this figure, a shooting direction corresponds to a throw direction normal to the machine, with no angle, opposite the shooter. Advantageously, in the case of the Olympic trap, the three machines are capable of shooting long this direction; indeed, the angular sectors of each of the three machines advantageously partially overlap. The preferred embodiment, particularly suited to the Olympic trap and illustrated, implements three machines, but the invention does not exclude more than three machine, in particular in a context of different shooting typologies.

Thus, the thrower 91 is configured according to an angular sector of deflection 61, 62, 63 amongst a plurality of different predetermined angular sectors comprising at least a first angular sector 61, a second angular sector 62 and a third angular sector 63.

Figure 5:
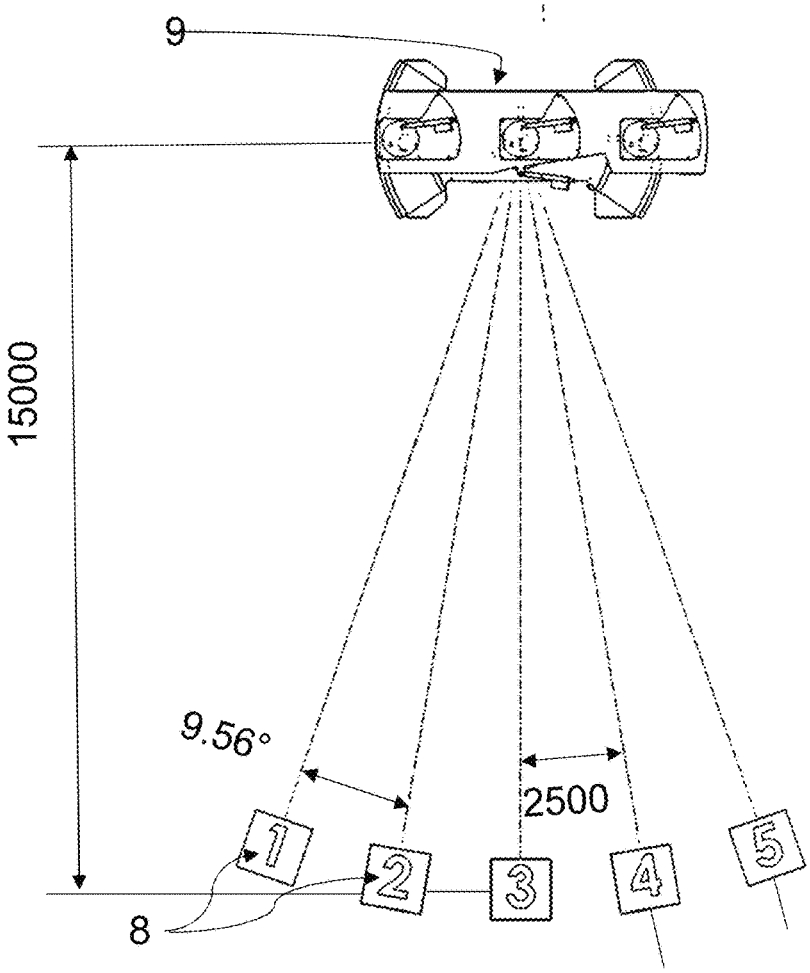
FIG. 5 represents a combination of three launchers according to the present invention.

Preferably, each thrower 91 is predefined according to a different angular sector. Preferably, the angular sector will be smaller than or equal to 60° and preferably smaller than or equal to 30°. According to one example and as illustrated in FIGS. 5 and 6, in a system 9, the three throwers 91 are aligned, preferably along a line perpendicular to a mediatrix passing through the shooting station and the machine located at the centre, the back of the thrower of the centre is directed so as to face the shooter 81 so that its median shooting direction 34 is aligned with the position of the shooter 81 and its total angular sector 62 is equal to 20° advantageously split into two angular sectors of 10° symmetrical with respect to the shooting direction 34. Preferably, the two other throwers 91 are also distributed so that their angular sector is arranged symmetrically with respect to the direction located at the level of a line at the level of the median projection direction of the central thrower 91 and possibly their angular sectors extend over 30° or 60°. Advantageously, the machine located to the right of the central machine has an angular sector of deflection at least primarily, and possibly completely, directed to the left, unlike the machine to the left.

According to one example, the actuator 71, 72, 73 comprises at least one anchoring unit, preferably located on at least one end. Advantageously, the anchoring unit is pivotable relative to the actuator 71, 72, 73, for example thanks to a system of simple bearings. The anchoring unit is formally configured so as to be able to cooperate with fastening elements on at least one anchor point, preferably on three different anchor points. The anchoring unit comprises a residual mobility to facilitate mounting and dismount of the actuator 71, 72, 73. For example, the anchoring unit may comprise a hook, an opening, an attachment system.

According to a non-illustrated example, the system for setting the angular sector of deflection comprises a pathway through an oblong hole able to cooperate with a fastening system, which may for example be a bolt element like a screw and/or a nut. Advantageously, the pathway takes on a curved trajectory. Preferably, on an anchor point, the actuator 71, 72, 73 may be dismounted from a first anchor point by loosening then reassembled and held in position in a second anchor point by tightening, preferably by screwing.

According to one example, the anchorage unit comprises an opening, a hook or a ball, capable of cooperating with receiving elements positioned at the anchor points. The receiving elements preferably consisting of rods, hooks, or any other mechanical element facilitating the set-up and holding in position of an actuator 71, 72, 73.

According to one embodiment, the first actuator 71 is an electric cylinder. Advantageously, it comprises two anchoring units, one of which is secured to the support 2 and the other one is located in contact with the base 1. Preferably, the anchorage unit, located in contact with the base 1, can be dismounted since it is located on one amongst the three anchor points.

According to one example, the base 1 is a plate, preferably metallic, which comprises a rounded protrusion at the anchor points and each anchor point defines a different angular sector of deflection.

System with Three Machines or Throwers

As illustrated in FIG. 5 and according to the invention, a system 9 comprises three throwers 91 which may be arranged within the same shelter 92 or trap.

In this figure, one could notice that the system 9 is integrated in a facility which comprises shooting lanes 8 in which a shooter could take position. In the illustrated example, corresponding to practice in the Olympic trap, there are five shooting stands. Advantageously, each shooting lane has a centre, the centres of the shooting lanes being arranged one after another according to a circle arc like line; preferably, the circle arc like line is centred on the base axis 112 of rotation of the common base, explained later on. In particular, the radius of the circle arc could correspond to a value of 15 m (cf. the 15,000 mm dimension in FIG. 5); alternatively or complementarily, the shooting stands may be spaced apart by 2.5 m (cf. the 2,500 mm dimension in FIG. 5); advantageously according to the circle arc, the shooting stands 8 are spaced apart by a constant angular sector, preferably by about 10°, corresponding for example to the 9.56° value as shown in FIG. 5.

The detail of the rotation of the common base 110 and of the relative position of the system 9 and of the shooting lanes 8 are given later on in the description.

Shooting Angles

According to one embodiment and as illustrated in FIG. 6, the three throwers 91 are configured so as to be able to be oriented according to an angular sector of deflection 61, 62, 63 comprising a shooting direction 34 able to cover a different angular sector for each of the three machines.

Anchor Points

According to one embodiment, each thrower has at least one angular sector of deflection 61, 62, 63 prior to an "Olympic trap" event. Preferably, these angular sectors are manually adjusted. Preferably, the actuator 71, 72, 73 is advantageously secured to two elements of the thrower 91 by two anchor points. For a given actuator, it is advantageously the distance between the two anchors which is modified by the motor to vary the shooting angle (or the shooting power). Yet, to modify the angular sector of this motor-driven deflection, the position of at least one of the anchorages is adjusted, preferably manually. Thus, the launcher 91 is advantageously configured so that the at least one anchor point of the actuator 71, 72, 73 could be easily dismounted from a first location then reassembled on a second location provided to this end. Thus, the at least one anchor point of the actuator 71, 72, 73 could vary, and therefore enable an optimisation of the positioning of the actuator with respect to the desired shooting direction sector 34.

According to one embodiment, the dismount of the actuator at least at one anchor point is performed using a mechanical fastening element which may be, for example, bolt parts, like for example a screw/nut system.

According to one embodiment, an adjustment clearance is provided at least at one anchor point of the actuator 71, 72, 73 in order to facilitate fastening thereof on the base 1 or on the support 2. For example, this could consist of an oblong adjustment hole.

According to a preferred embodiment, a system 9 comprises three throwers 91 which differ only by the anchor point of an actuator 71, preferably, it will consist of the first actuator 71.

According to one example, all throwers 91 are identical in that they include exactly the same components.

Example According to a Particular Embodiment

In FIGS. 7A to 7F, an example according to a particular embodiment is illustrated wherein an actuator 71, 72, 73 is advantageously positioned in order to vary a shooting direction 34 within a preset angular sector 61, 62, 63. Indeed, the modification of the positioning of the actuator preferably makes another angular sector of the shooting direction 34 functional. In each of the three configurations provided for the angular sectors, the shooting direction 34 is included within the angular sector of deflection 61, 62, 63 which is adjusted.

According to this last example, the first actuator 71 is advantageously secured to the thrower 91 at two anchor points. A first anchor point is located on the support 2. A second anchor point is located on base 1. According to a preferred embodiment, at this second anchor point, the first actuator 71 is configured so as to be dismounted, and then mounted again on at least one additional anchor point, preferably two additional anchor points, located on the base 1. According to one possibility, it is one end of the rod of a cylinder of the actuator 71 which is connected to an anchor point of the support and one end of the body of the cylinder of the actuator 71 which is connected to an anchor point of the base.

Figure 7A:
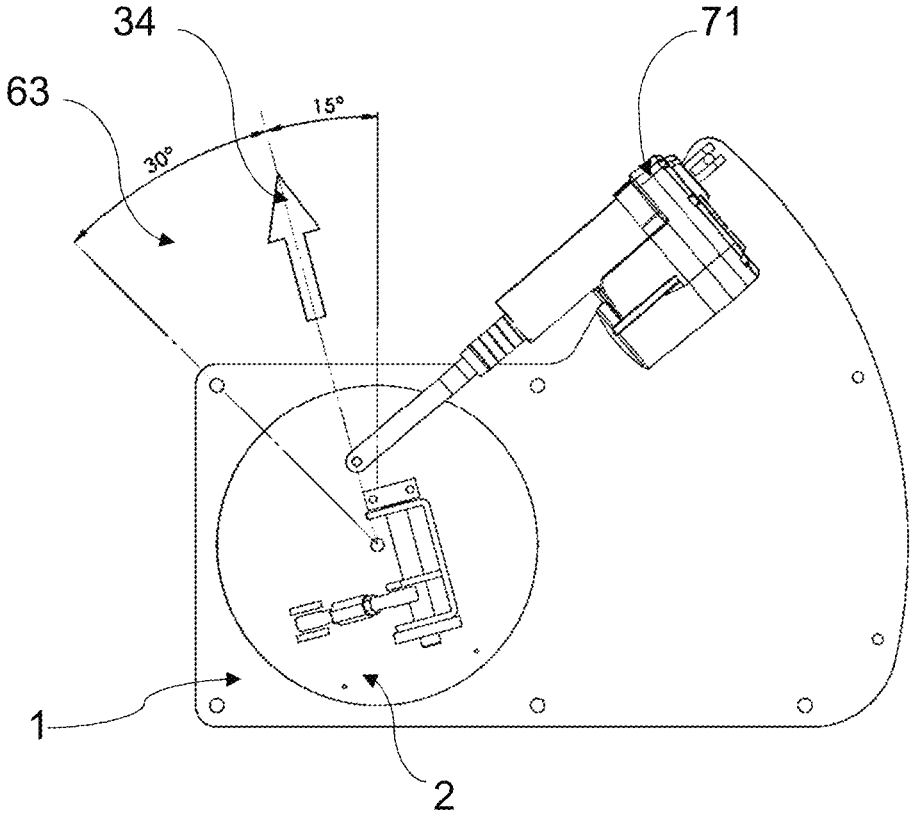
FIGS. 7A to 7F represent an adjustment of an anchor point of an actuator in three different positions and according to the invention.

Preferably, the possible anchor points of the base are differently spaced apart from the anchor point of the support so that, in each of the situations represented in FIGS. 7A/7B, 7C/7D, 7E/7F, the length of the actuator between the two anchor points is different. In the case of a cylinder, this corresponds to a different extension length of the rod of the cylinder in the three situations. In other words, the formation of each angular sector is performed by modifying the translational stroke sector of the actuator, and for example of the rod of a cylinder. The angular sectors may overlap, such that the translational stroke sectors of the actuator could also overlap but they are different.

Figure 7B:
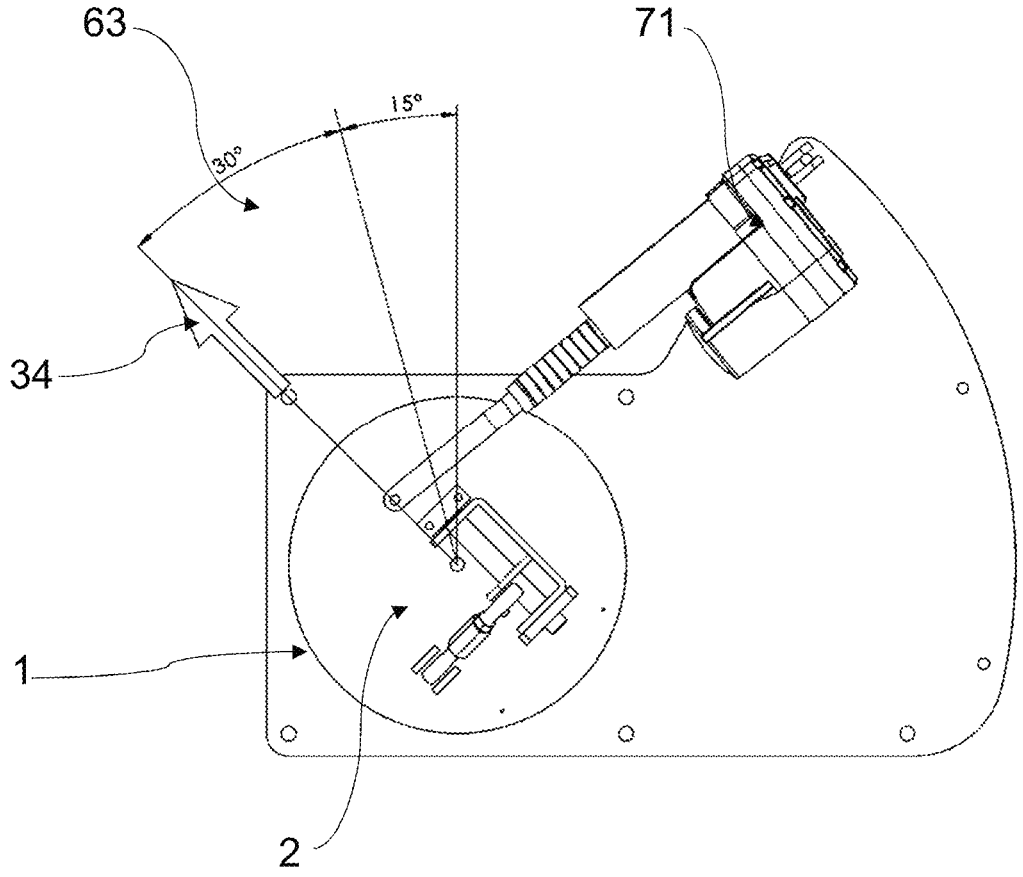

Thus, the machine of FIGS. 7A and 7B preferably corresponds to the machine on the right of FIG. 6. In general, the cylinder rod is more retracted than in the other two positions, of FIGS. 7C/7D and 7E/7F. Thus, in FIG. 7A, a shooting direction 34 is located in the sector 63. As the rod is more retracted, its extension deflection is larger, which enables an actuation of the support 2 primarily in a counterclockwise direction. This is what allows reaching the position represented in FIG. 7B which herein corresponds for example to a limit of the angular sector 63.

Figure 7C:
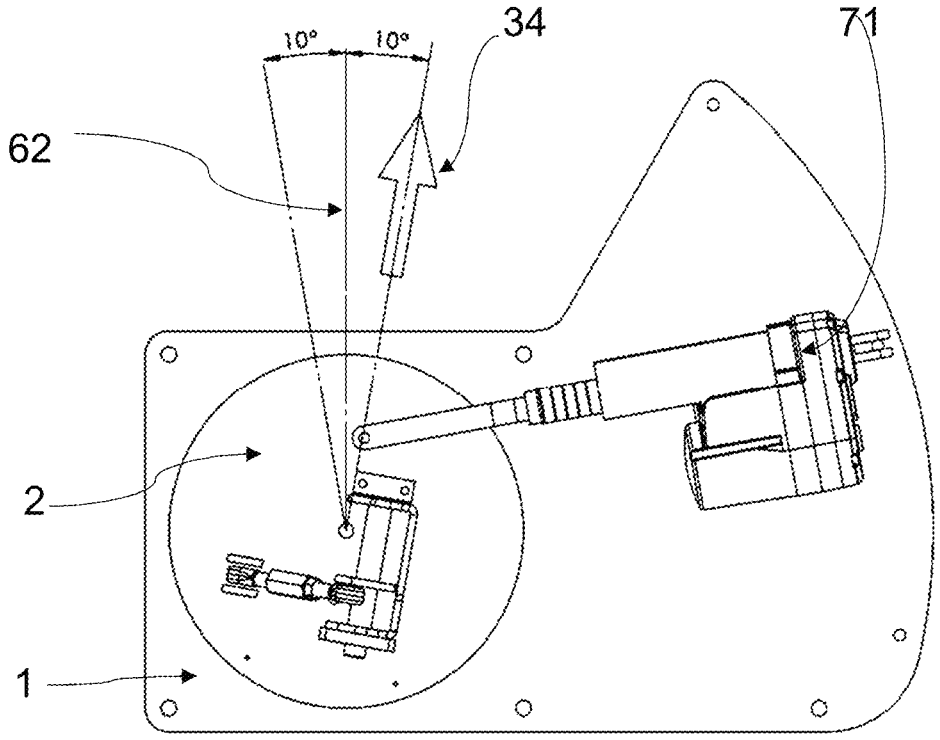
Figure 7D:
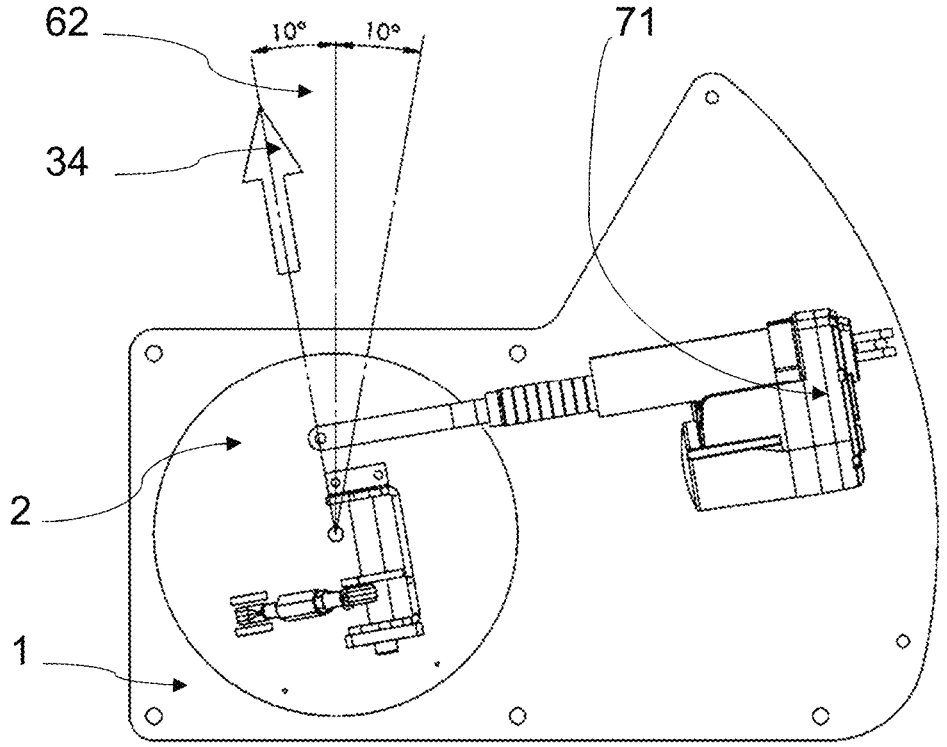

Preferably, the machine of FIGS. 7C and 7D corresponds to the machine in the middle of FIG. 6. The distance separating the two anchorages is shorter than in the previous case and this position is advantageously configured so that the rod could move in translation over strokes with an equivalent length in retraction or in extension around the represented position, which may correspond to a neutral position. The two extreme positions of the rod of the cylinder respectively correspond to the illustrations of FIGS. 7C and 7D to modify the shooting direction 34 in the sector 62 accordingly.

Figure 7E:
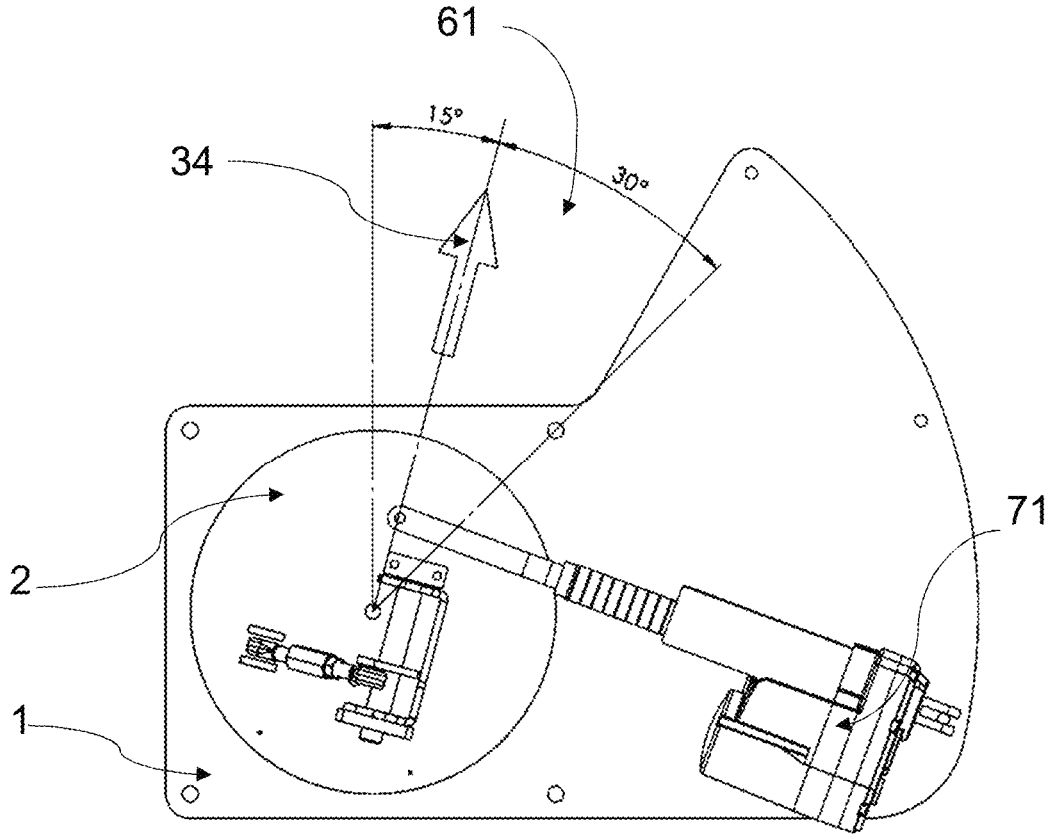
Figure 7F:
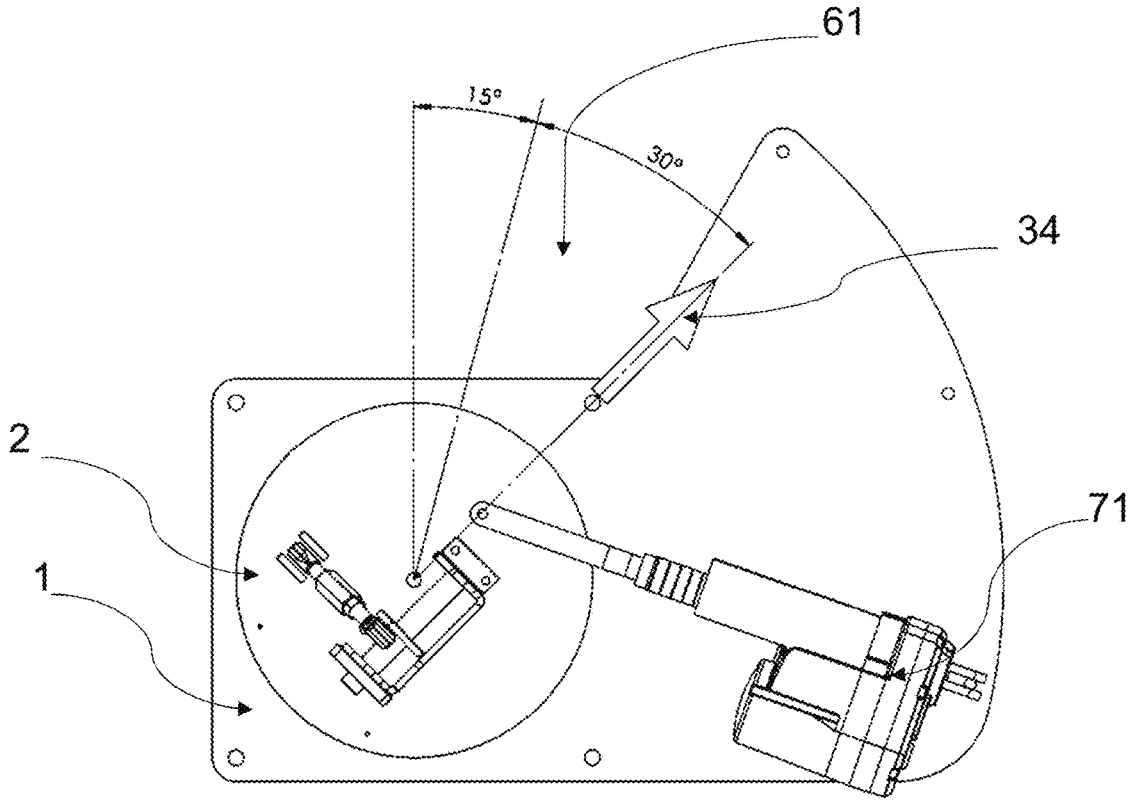

Preferably, FIGS. 7E and 7F correspond to the machine on the left in FIG. 6. This time, the distance between the anchors is maximum, such that the actuator 71 is the most extended in this position. In the case of a cylinder, it is in this situation that the rod is extended the most, for a throw right to the trench. On the other hand, the length of the retraction stroke of the rod of the cylinder is longer, which allows for a greater deflection in a counterclockwise direction. Thus, it is possible to operate a 30° movement in the sector 61 by a retracting movement of the rod of the cylinder from the shooting direction 34 of FIG. 7E to that of FIG. 7F.

As a result of the previous explanations, one aspect of embodiments of the machine allows modifying the length of the extending rod in a situation for a shot right to the trench by modifying at least one of the anchorages of the cylinder. Thanks to this modification, it is possible to modify the stroke of the cylinder in the direction of rod extension and the stroke of the cylinder in the direction of rod retraction. Thus, it is possible to make the actuator 71 of one of the machines work so that the covered angular sector is primarily induced by an extension translation of the rod. Furthermore, it is possible to make the actuator 71 of another machine work so that the covered angular sector is primarily induced by a retraction translation of the rod. What is more, the actuator 71 of another machine, preferably the central machine, could be made to work, so that the covered angular sector is distributed identically between the extension stroke and the retraction stroke of the rod of the cylinder.

The explanations given before are applicable mutatis mutandis to a deflection of parts movable in translation other than the rod of a cylinder, for example an arm of a crank-rod system.

Variants and Other Embodiments (Base on Rotating Carriage, Base on Translation Carriage Anchorage)

According to a particular embodiment, the base is removable and the actuator 71, 72, 73 may be non-removable. Preferably, the base is mounted on a carriage movable in rotation and whose rotation could be blocked according to three predefined anchor points.

According to another embodiment, the base 1 is mounted on a carriage movable in translation.

Electric Cylinder

According to a preferred embodiment, at least one of the actuators 71, 72, 73 is an electric cylinder. Preferably, these may consist of 12V electric cylinders associated with sensors dedicated to the positioning of the actuators, which may be of the potentiometer, optical or Hall effect type. According to one example, the number of pulses per mm of stroke is 12,599 and the acceptable load is 6,000 N. In each angular sector 61, 62, 63, the stroke of the cylinder may be short, for example less than 5 cm.

Angular Sectors of Deflection

Figure 8:
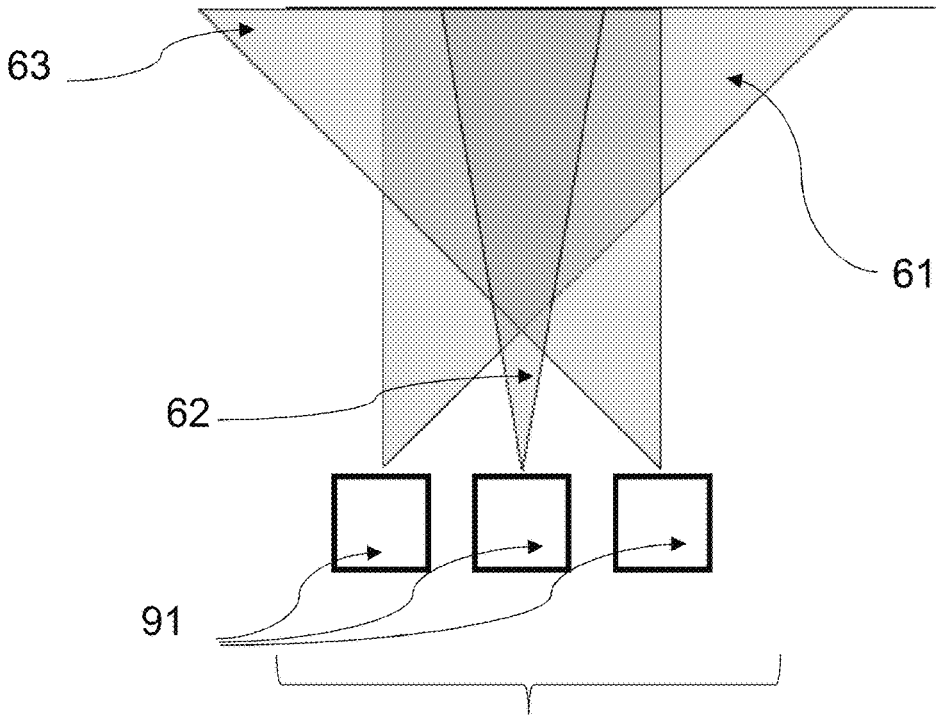
FIG. 8 shows in a view parallel to the ground a diagram in the form of an area of the angular sectors of a system of three throwers according to the invention.

As illustrated in FIG. 8 and according to an embodiment of the invention, the system 9 comprising three throwers 91 is configured so as to be able to project targets 4 according to three different angular sectors, a first angular sector 61, a second angular sector 62 and a third angular sector 63.

Second Adjustment Direction

According to a particular embodiment wherein a first adjustment is configured to enable a disassembly of a first actuator 71 from a first location then reassembly of the first actuator 71 in a second location, the invention provides for least at one equivalent second adjustment to be performed on at least one second actuator 72. Possibly the thrower 91 is configured so as to enable an equivalent third adjustment of at least one third actuator 73.

Power Adjustment

According to a particular embodiment, the thrower 91 comprises a system for varying the throw tension operating thanks to an elastic element and preferably a spring, typically a spring tensioned during a cocking phase. Preferably, the actuator 73 comprises an anchor connected to one end of the spring so that the tension of the cocked spring could be adjusted according to the position of this anchor.

Advantageously, the system is configured to keep a projection distance constant despite the modification of at least one angular position per actuator 7.

According to one embodiment, the origin of movement of the actuators 71, 72, 73 or the load of the spring(s) may be moved electronically within a computer member in order to compensate for the variations in trajectory due to altitude, winds or other meteorological parameters.

According to one embodiment, a sequencer controls the system 9 comprising the three throwers 91. Preferably, it integrates the data relating to all trajectories and manages, for example, the evolution of the combinations during the shooting session for one or more shooter(s) 81. The sequencer may comprise a processor and a memory for storing instructions allowing executing actuator commands.

In the context of training and according to a particular embodiment, the sequencer also offers the possibility of selecting specific trajectories, repeating them, and modifying the difficulty thereof by decreasing or increasing the speed of projection of the targets 4, or by creating a customised shooting sequence.

According to one example, the sequencer also determines which thrower 91 should be activated for the upcoming shot.

According to one embodiment, the invention comprises an interface between the shooter and the sequencer. Preferably, it may consist of a radio controller comprising an emitter and a receiver, the emitter may for example consist of a "Lavalier microphone" in order to enable a departure of the target upon a vocal command or a command of more complex acoustic devices using microphones on a tripod.

Example of a Common Base Movable in Rotation

Figure 9:
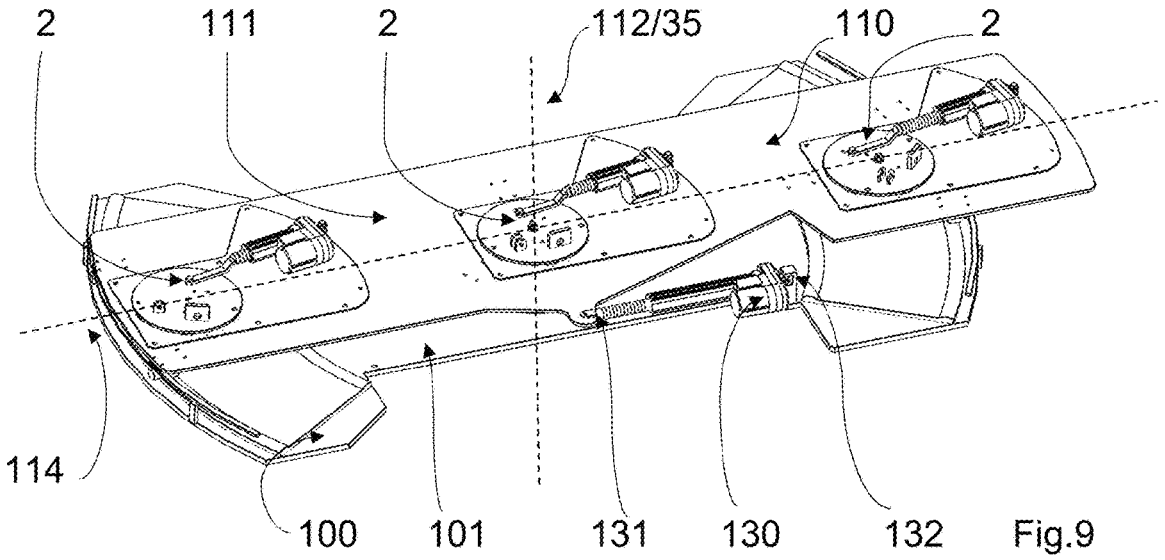
FIG. 9 shows in perspective an example of mounting a base common to the three machines on a stand.

FIG. 9 provides a perspective view of the cooperation of a stand 100 and of a common base 110 receiving each of the machines.

Preferably, the stand 100 is fixed with respect to the ground, yet this arrangement is not exclusive. An upper face 101 of the stand supports the common base 110; the latter itself has an upper face 111 supporting the machines; the support 2 of each machine is pivotally mounted relative to the common base 110. The common base 110 has a face opposite to its upper face 111 which faces the upper face 101 of the stand 100. The common base 110 is pivotally mounted relative to the stand 100, about a geometric axis 112, herein referred to as base axis.

In the illustrated example, the stand 100 may be a metallic foundation element of all of the three machines. Advantageously, the common base 110 is a planar structure and may be at least partially formed by a metallic plate; the machines 91 being aligned on the common base 110, the latter may have an elongate shape as shown in FIG. 9, the three machines being arranged one after another along their direction of alignment 114. Advantageously, the main directions 35 of he machines 91 have the same spacing (for example between 1 metre and 1.10 metre), the second machine being located at the centre with respect to the two other ones.

Preferably, the base axis 112 is coincident with the main direction 35 of the machine 91 arranged at the middle, i.e. the second machine along the direction of alignment 114. Thus, the rotation of the support 2 and the rotation of the common base 110 are performed according to the same axis, the set being therefore perfectly centred.

FIG. 9 also shows that movability relative to the common base 110 may be produced by means of a base actuator 130; in the illustration, the latter has a first connection 131 to mount it, preferably rotatably, on the common base 110 and a second connection 132 to mount it, preferably rotatably, on the stand 100.

As regards the actuator 130, for example, it is possible to use an electric cylinder, for example with a rated voltage of 12 V; sensors dedicated to positioning of the cylinder (an possibly to positioning of other actuators of the machines) may be of the potentiometer, optical or Hall effect type. In the case of the figures, the actuator acts on a lever arm directed towards the centre of the common base 110 perpendicular to the direction of alignment 114 of the three machines.

Figure 10:
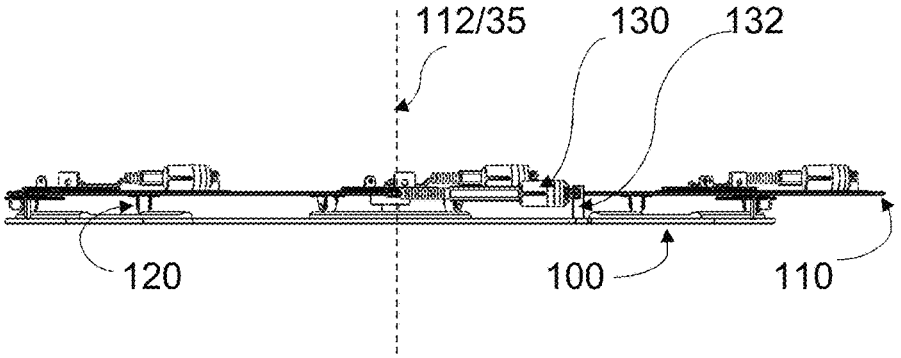
FIG. 10 is a profile view of the elements shown in FIG. 9.

FIG. 10 offers another view of the embodiment of FIG. 9, in profile, in a vertical plane in the normal position of use of the system.

Figure 11:
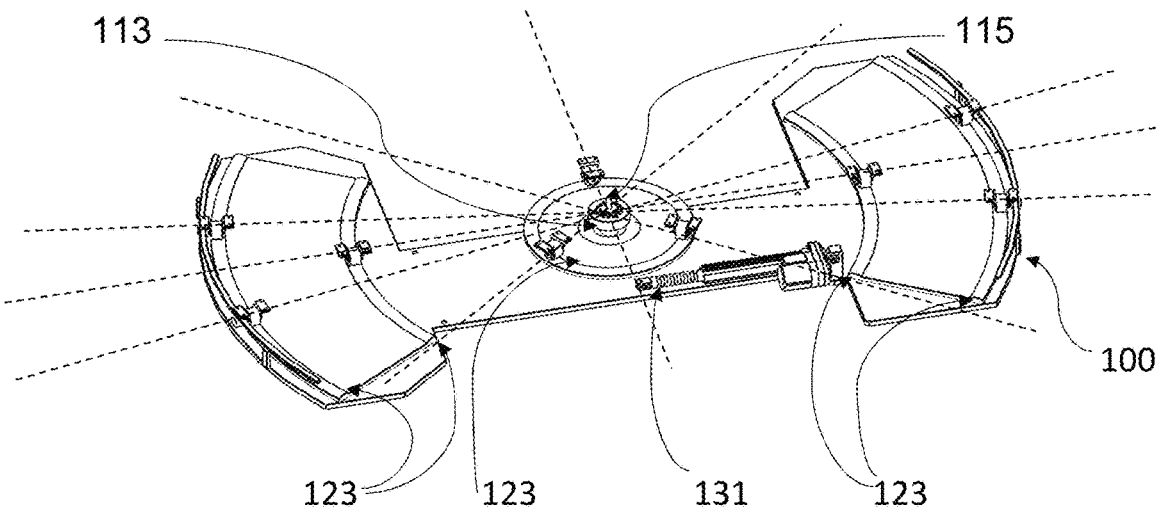
FIG. 11 gives details of the rotational articulation of some elements.

To ensure the rotation of the common base 110 relative to the stand 100, a rolling device 120 is provided. In the illustrated embodiment, rolling tracks 122 (herein formed over the upper face 101 of the stand 100) are used on which rollers 121 (herein rotatably mounted on the lower face of the common base 110, along an axis perpendicular to the base axis 112 and directed along a radius of the circular trajectory of the common base 110) move. The rolling tracks 122 have a circular profile, either shaped into a circle arc, as is the case for the two end rolling sets 123 shown in FIG. 11 and arranged at the first machine and the third machine, or shaped into a complete circle, as is the case of the rolling set 123 arranged at the second machine.

Figure 12:
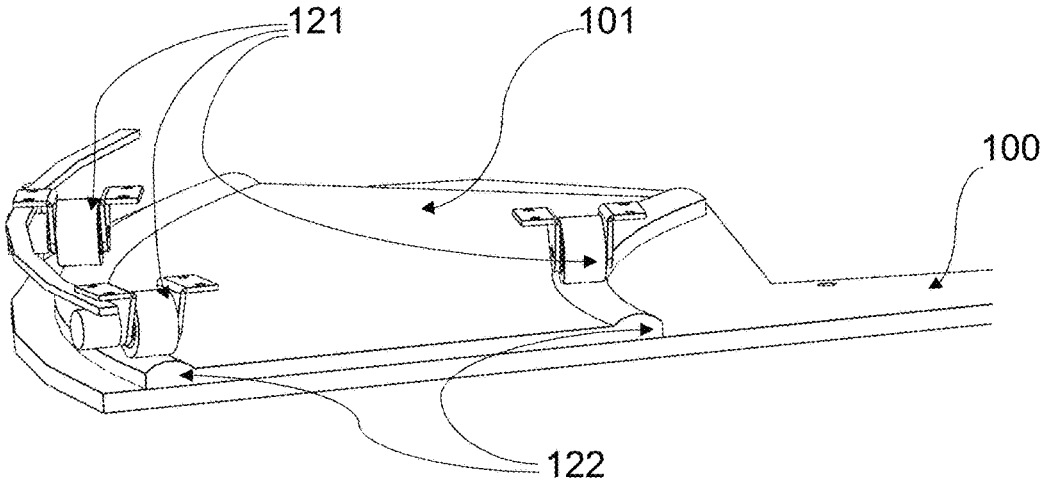
FIG. 12 is a detail view of a portion of a rolling device.

According to one possibility, for each machine, a rolling set 123 is associated, i.e; located at the same level as the machine, and preferably opposite, below, the support 2. A set 123 may include two rolling tracks 122 arranged over two circles with different diameters centred on the base axis 112. Preferably, the main axis 35 of each machine is arranged between each of these two tracks, and preferably midway. This allows balancing force recoveries. For a considered rolling track 122, at least one roller 121 is used, and for example one or two roller(s). For example, it is possible to provide for a total of three rollers for a set 123, to form a force recovery at three points, as shown in FIG. 12 with regards to the first machine 91.

Figure 13:
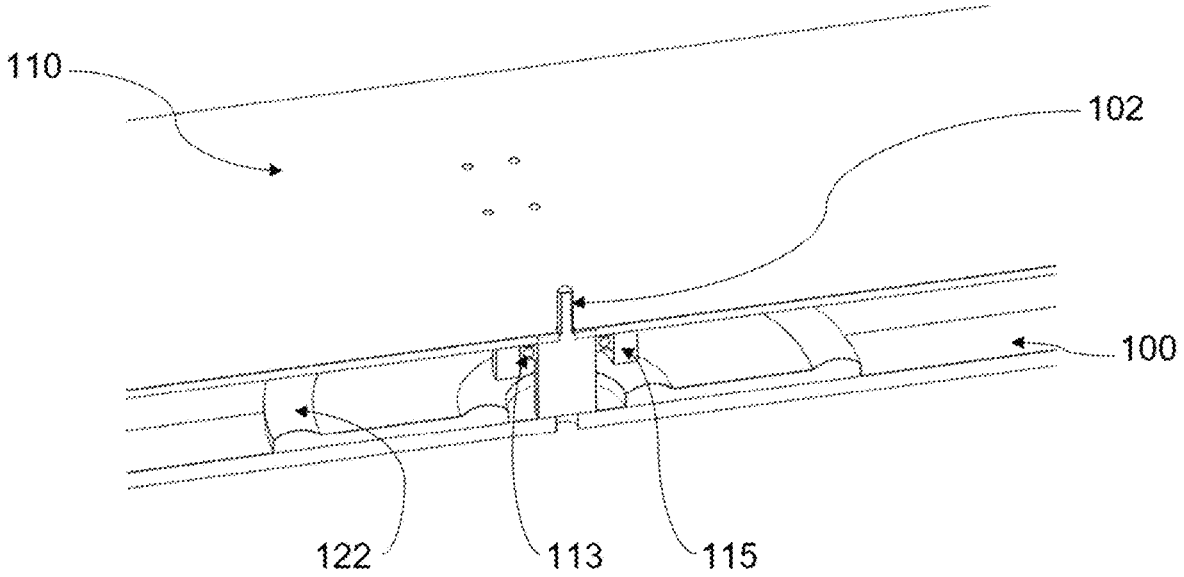
FIG. 13 is a detail view of another portion of a rolling device.

At the base axis 112, the common base 110 is provided in its lower portion, at its centre, with a ring 115 containing a bearing, as shown in FIG. 13 more particularly. A shaft 102 secured to the stand 100 allows centring the common base 110 across its thickness.

FIGS. 14A to 16B give examples of sequences of movement of the common base 110 to adapt to different shooting lanes 8.

Figure 14A:
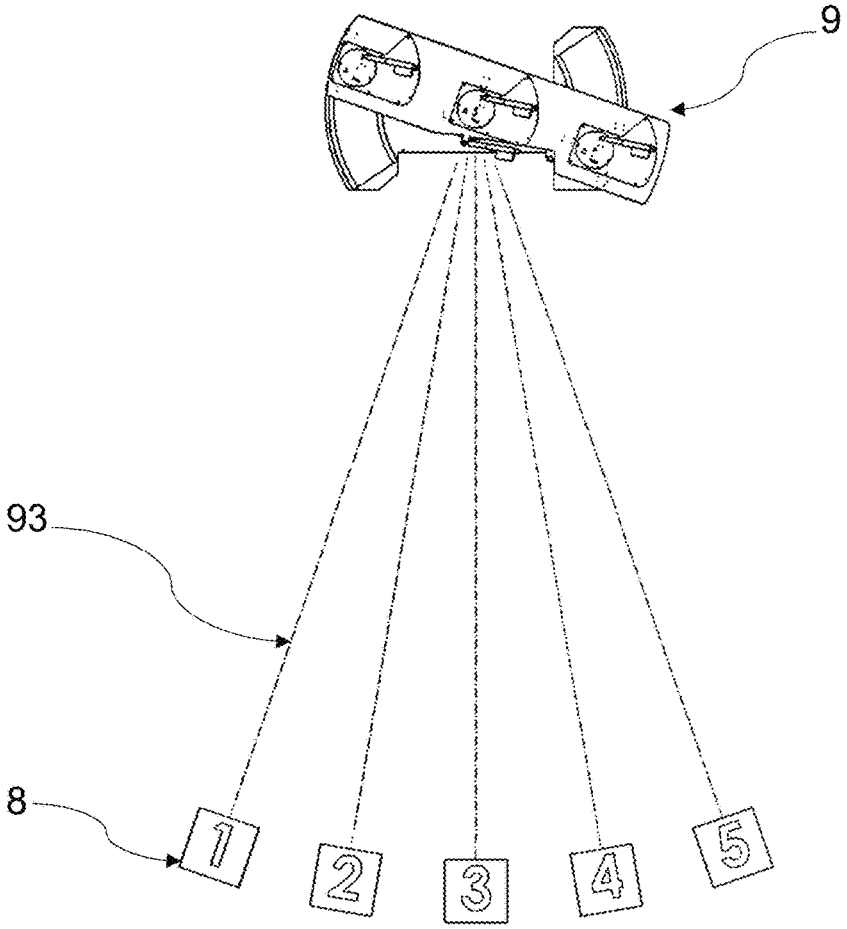
FIG. 14A is a top view of a facility, in a first angular position of the common base, suited for shooting from a first shooting lane.
Figure 14B:
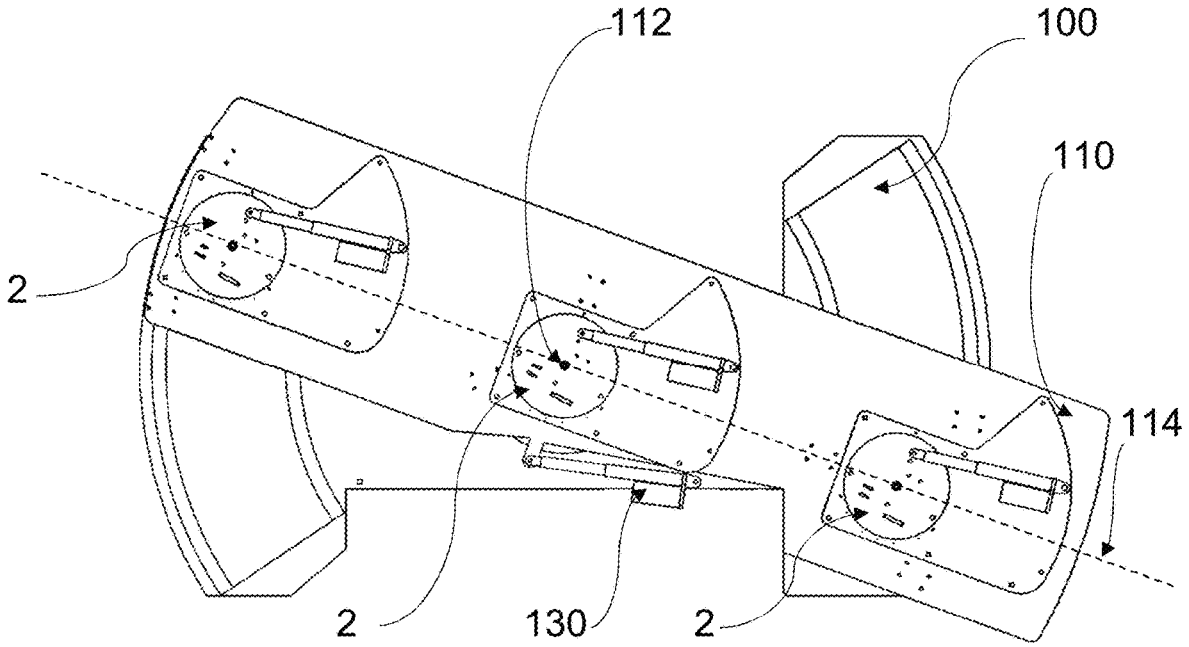
FIG. 14B is a top view of the system in the angular position of the previous figure.

In the illustrated example, featuring five shooting lanes 8, the common base 110 performs preferably successively four rotations by about 10° each in a first direction (for example counterclockwise) from an end shooting lane 8, like that one bearing the number 1 in FIG. 14A; each time, the execution of a target throw is done. Once arrived at the station bearing the number 5, the common base 110 is set in rotation in the opposite direction, to cover a reverse way throughout all shooting lanes 8, to return to the shooting lane number 1.

As shown in FIG. 14A, a configuration for shooting from the lane number 1 is such that the line 93 passing through the centre of the considered shooting lane and the base axis 112 is perpendicular to the direction of alignment 114 of the machines. This corresponds to the angular position of the common base 110 shown in FIG. 14B.

Figure 15A:
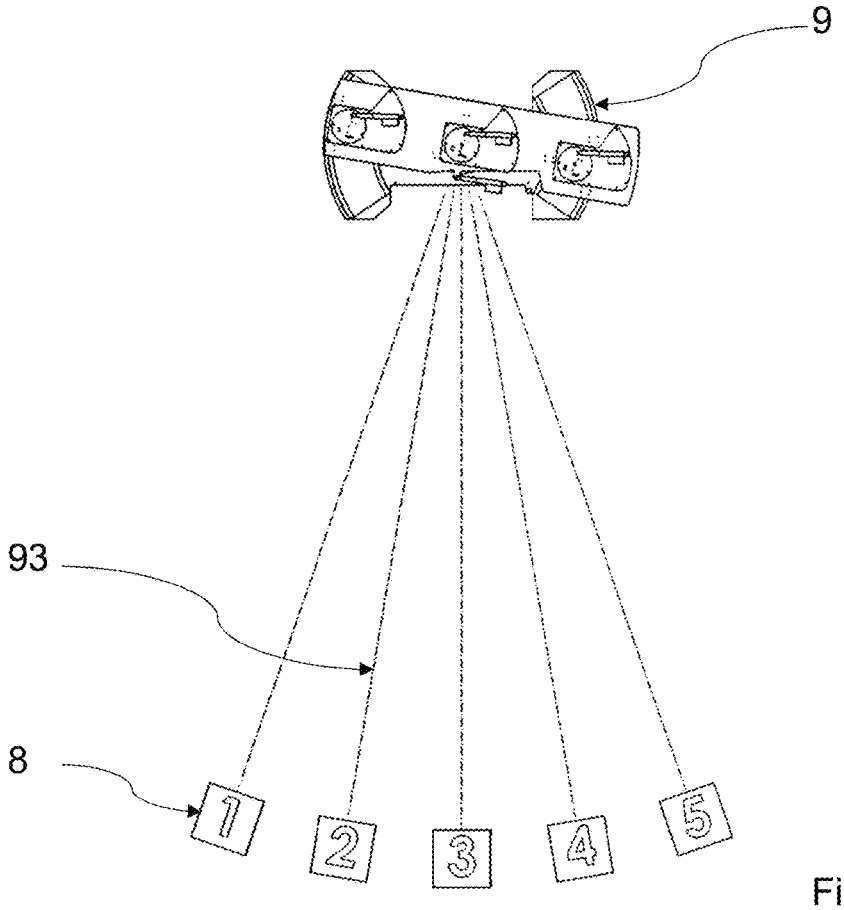
FIG. 15A is a top view of a facility, in a second angular position of the common base, suited for shooting from a second shooting lane.
Figure 15B:
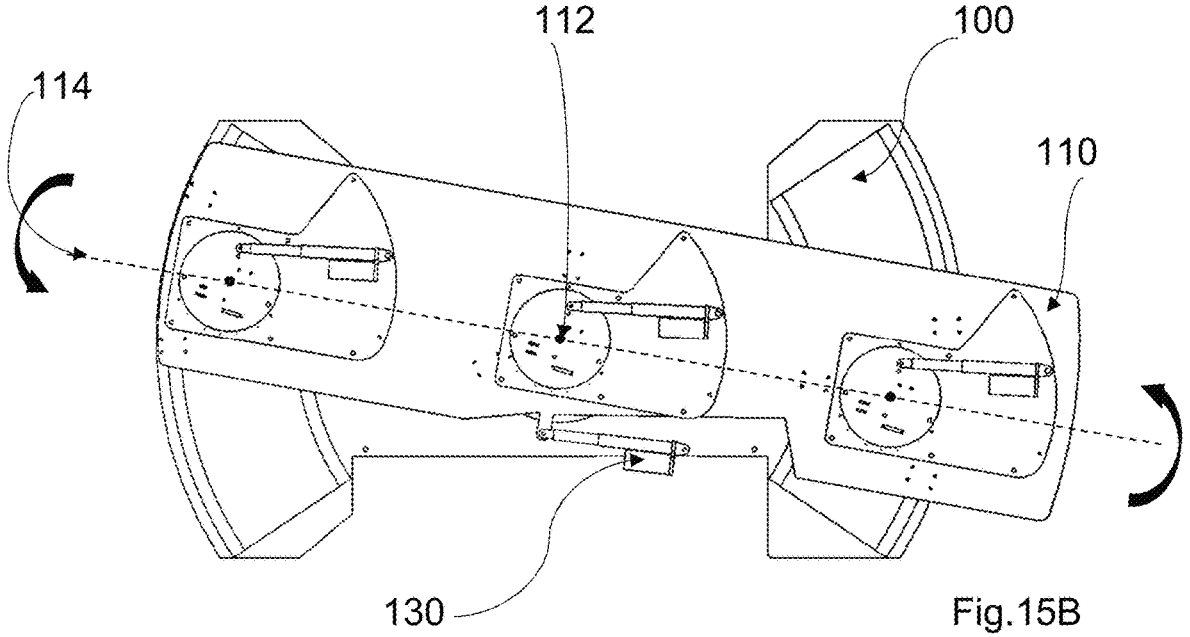
FIG. 15B is a top view of the system in the angular position of the previous figure.

To adapt to the next shooting lane, the shooting lane number 2 in FIG. 15A, the common base 110 performs a rotation, schematised by the arrows in FIG. 15B. It is the line 93 corresponding to the shooting lane number 2 which is then adjusted.

Figure 16A:
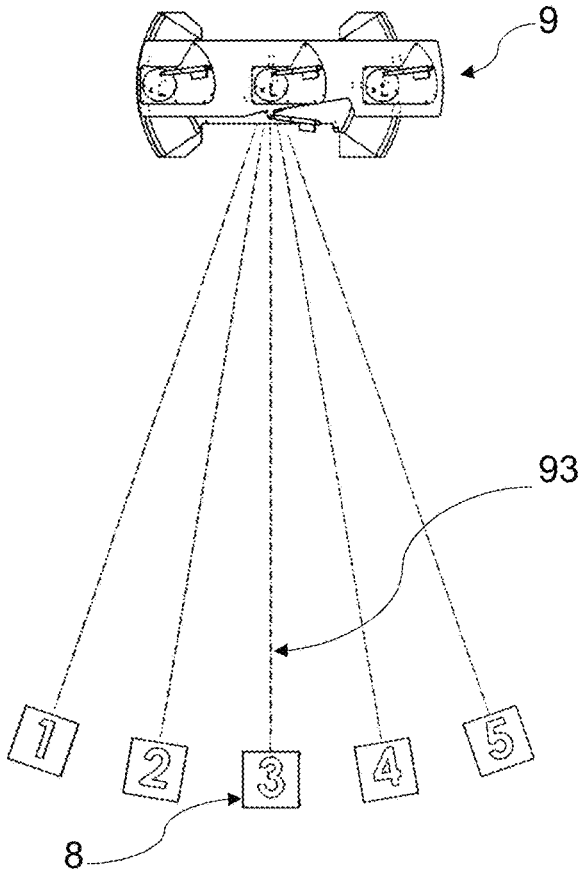
FIG. 16A is a top view of a facility, in a third angular position of the common base, suited for shooting from a third shooting lane.
Figure 16B:
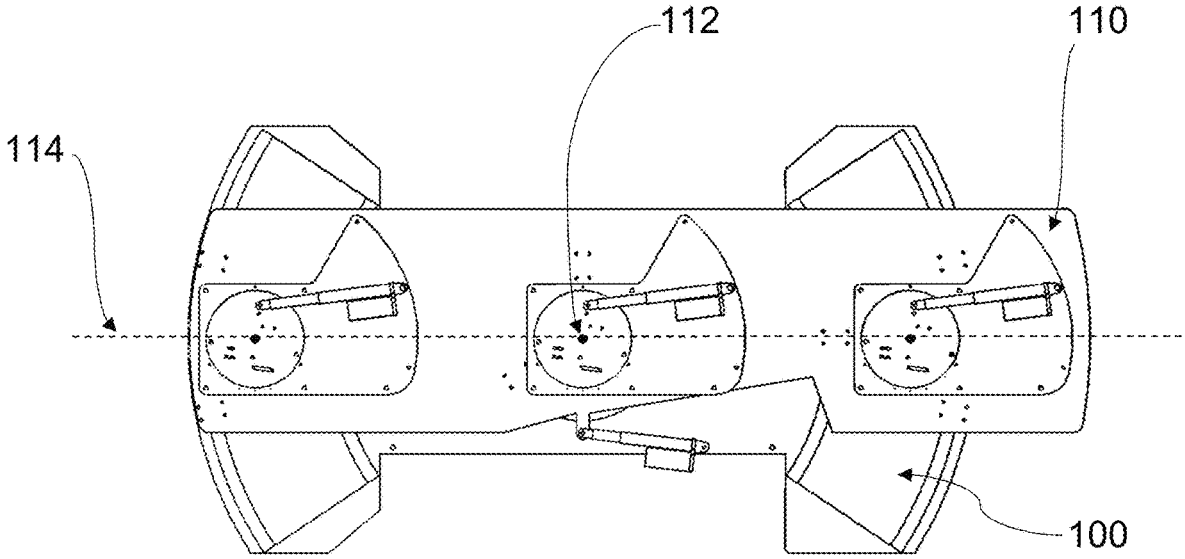
FIG. 16B is a top view of the system in the angular position of the previous figure.

FIG. 16A shows the adjustment to the shooting lane number 3 which is herein central. FIG. 16B shows the relative position of the common base 110 and of the stand 100. As indicated before, additional successive movements are advantageously carried on up to the shooting lane number 5, in the same manner.

According to one embodiment, the invention provides for a solution in which an "Olympic Trap" with three throwers 91, preferably arranged within a shelter 92.

The invention is not limited to the previously-described embodiments and covers all embodiments in accordance with its spirit.

REFERENCE NUMERALS

1. Elementary base
2. Support
20. Axis
3. Throwing unit
31. Throwing plate
32. Throwing arm
33. Axis of rotation
34. Shooting direction
35. First direction
36. Second direction
37. Revolving cylinder
4. Target
61. First angular sector
610. Lateral limit
62. Second angular sector
63. Third angular sector
71. First actuator
72. Second actuator
73. Third actuator
8. Shooting platform
81. Shooter
9. System
91. Machine
92. Shelter
93. Line
100. Stand
101. Upper face
102. Shaft
110. Common base
111. Upper face
112. Base axis
113. Shaft bearing
114. Direction of alignment
115. Support pivot ring
120. Rolling device
121. Roller
122. Rolling track
123. Par of rolling sets
130. Base actuator
131. First connection
132. Second connection

The invention claimed is:

1. A target throwing system for sport shooting comprising, successively along a direction of alignment, a first target throwing machine, a second target throwing machine, and a third target throwing machine, each of the first machine, the second machine and the third machine comprising:

a throwing unit movable in rotation relative to a base, a throwing arm movable in rotation relative to the throwing unit, wherein the base is a base common to the first target throwing machine, the second target throwing machine and the third target throwing machine, and in that it includes a stand on which the common base is movable in rotation along a base axis, further wherein each amongst the first machine, the second machine and the third machine is configured to respectively sweep a first angular sector of deflection, a second angular sector of deflection and a third angular sector of deflection, said sectors being different from each other.

2. The system according to claim 1, wherein the base axis is coincident with the axis of rotation, with respect to the common base, of the throwing unit of the second machine.

3. The system according to claim 1, comprising a base actuator, configured to drive the common base in rotation relative to the stand.

4. The system according to claim 1, comprising a rolling device interposed between an upper face of the stand and a lower face of the common base.

5. The system according to claim 4, wherein the rolling device includes at least one rolling set comprising on the one hand a rolling track with a circle arc shaped profile centred on the base axis and arranged on one amongst the upper face of the stand and the lower face of the common base, and, on the other hand, at least one roller rotatably mounted on the other one amongst the upper face of the stand and the lower face of the common base and configured to move along the rolling track.

6. The system according to claim 5, wherein the rolling device includes several rolling sets at least some of which have rolling tracks having different spacings with respect to the base axis.

7. The system according to claim 6, wherein the rolling device comprises four rolling sets arranged in pairs on either side of the axis of rotation, relative to the common base, respectively of each amongst the first machine and the second machine.

8. The system according to claim 7, wherein each pair of rolling sets is arranged opposite a different one amongst the throwing unit of the first machine and the throwing unit of the third machine.

9. The system according to claim 6, wherein the rolling device includes, at least one rolling set arranged opposite the throwing unit of the second machine.

10. The system according to claim 9, wherein the rolling set arranged opposite the throwing unit of the second machine includes a circle-like shaped rolling track.

11. The system according to claim 1, wherein each amongst the first machine, the second machine and the third machine includes a system for setting the angular sector of deflection allowing selectively reducing the angular sector of deflection to one amongst the first angular sector, the second angular sector and the third angular sector.

12. A facility for sport shooting comprising a target throwing system for sport shooting comprising, successively along a direction of alignment, a first target throwing machine, a second target throwing machine, and a third target throwing machine, each of the first machine, the second machine and the third machine comprising:

a throwing unit movable in rotation relative to a base, a throwing arm movable in rotation relative to the throwing unit, wherein the base is a base common to the first target throwing machine, the second target throwing machine and the third target throwing machine, and in that it includes a stand on which the common base is movable in rotation along a base axis and a plurality of shooting lanes arranged successively along a circle arc centred on the base axis.

13. The facility according to claim 12, wherein the system is configured to move the common base in rotation relative to the stand to alternately place the common base in one amongst a plurality of angular positions, each position corresponding to a situation in which the direction of alignment is perpendicular to a line passing through the base axis and the centre of one of the shooting lanes.

14. A method for controlling a target throwing system according to claim 1 in a facility for sport shooting comprising the target throwing system and a plurality of shooting lanes arranged successively along a circle arc centred on the base axis and configured to move the common base in rotation relative to the stand to alternately place the common base in one amongst a plurality of angular positions, each position corresponding to a situation in which the direction of alignment is perpendicular to a line passing through the base axis and the centre of one of the shooting lanes, the method comprising:

placing the common base with respect to the stand in an angular position of the plurality of angular positions, executing at least one projection of at least one target, moving the common base in rotation relative to the stand up to another angular position of the plurality of angular positions, executing again at least one projection of at least one target.

15. The method according to claim 14, wherein the placement is done in an angular position corresponding to a shooting lane located at a first end of the circle arc and wherein the rotational movement and the new execution are done successively up to a shooting lane located at a second end of the circle arc.

* * * * *